US007866285B2

(12) United States Patent
DuQuette et al.

(10) Patent No.: US 7,866,285 B2
(45) Date of Patent: Jan. 11, 2011

(54) COOLING AIR CONDUIT FOR V-TWIN CYLINDERS

(76) Inventors: Raymond D. DuQuette, 252 Stony Brook Dr., Ione, CA (US) 95640-9671; Kenneth DuQuette, 252 Stony Brook Dr., Ione, CA (US) 95640

( * ) Notice: Subject to any disclaimer, the term of this patent is extended or adjusted under 35 U.S.C. 154(b) by 427 days.

(21) Appl. No.: 12/114,075

(22) Filed: May 2, 2008

(65) Prior Publication Data

US 2009/0272342 A1 Nov. 5, 2009

(51) Int. Cl.
*F01P 1/00* (2006.01)

(52) U.S. Cl. ..... 123/41.56; 123/41.62

(58) Field of Classification Search ..... 123/41.56, 123/41.61, 41.62
See application file for complete search history.

(56) References Cited

U.S. PATENT DOCUMENTS 2,710,601 A * 6/1955 Kloss ..... 123/41.61

* cited by examiner

*Primary Examiner*—Noah Kamen

(57) ABSTRACT

A cooling air conduit for motorcycle engine which is particularly suitable for V-twin cylinders is provided which is constructed of a conduit body of elongated, tapered shape formed by a top panel, a bottom panel and two side panels such that a cool air passageway is formed inbetween the panels to direct cool air, away from the first cylinder, and onto the second or rear cylinder for efficient cooling.

6 Claims, 2 Drawing Sheets

COOLING AIR CONDUIT FOR V-TWIN CYLINDERS

FIELD OF THE INVENTION

The present invention generally relates to a motorcycle accessory and more patricianly, relates to a cooling air conduit for V-twin cylinders on a motorcycle.

BACKGROUND OF THE INVENTION

Motorcycling is a popular sporting event in the United States and in the rest of the world. One of the popular motorcycles for the motorcycle enthusiasts is one that is equipped with a twin cylinder arranged in a V con figuration. An inherent problem of the V-twin engine is that the cylinder situated in the rear position does not get adequate cooling. When cool air first encounter the motorcycle while it is in motion, the front cylinder gets adequate cooling while only warm air circulates around the rear cylinder such that it is not adequately cooled. In adequately cooled engine cylinder may cause malfunction of the motorcycle engine, for instance may cause the cylinder to burn up and require replacement. It is therefore desirable to provide a device that can adequately cool the rear cylinder a V-twin motorcycle engine such that overheating of the rear cylinder does not occur.

It is therefore an object of the present invention to provide a motorcycle accessory that can assist the cooling of the rear cylinder of a V-twin engine.

It is another object of the present invention to provide a cooling air conduit that can be mechanically attached to the rear cylinder of a V-twin engine such that the rear cylinder of the engine can be adequately cooled.

SUMMARY OF THE INVENTION

In accordance with the present invention, a cooling air conduit for motorcycle engine cylinders is provided.

In a preferred embodiment, the present invention cooling air conduit for motorcycle engine cylinders is constructed of a conduit body of elongated, tapered shaped formed by a top panel, a bottom panel, and two side panels, the two side panels has a width that is less than ⅓ of a width of the top or bottom panels; a passageway formed inbetween the top, bottom panels and the two side panels which has an inlet and an outlet for cool air to pass therethrough; a first length of the top panel larger than a second length of the bottom panel wherein an end portion of the bottom panel at the outlet curves away from the top panel to deflect a hot air flow from an adjacent engine cylinder away from an engine cylinder to be cooled; and at least one mounting hole at an end portion of the top panel for mechanically attaching the conduit body to the engine cylinder to be cooled.

BRIEF DESCRIPTION OF THE DRAWINGS

The invention will now be described, by way of example, with reference to the accompanying drawings, in which.

DETAILED DESCRIPTION OF THE PREFERRED EMBODIMENT

The present invention discloses a cooling air conduit for V-twin cylinders on motorcycles.

The present invention cooling air conduit is a cooling tube for the rear cylinder a V-twin motorcycle engine. Normally, the rear cylinder is starved of cooling air while traveling, which can eventually cause the cylinder to burn up and require replacement. This supplemental cooling device would keep the temperature of the cylinder down for efficient operation and a long product life. It would also help prevent temperature escalation beneath the motorcyclists' seat for more comfortable riding conditions. The tubular product measures approximately 18 inches long, 7½ inches tall, and 4 inches wide. The front end of the sheet metal tube is directed forward to the front left side of the lead engine cylinder. This accepts cool intake air not already heated by the first cylinder.

The present invention apparatus has a secure mounting device to anchor it into position. One half of the mounting would be welded to the cooling air conduit and the other would secure the mount to the heat transfer find of the V-twin with a screw driven working cam. The screw would be directed through these two parts to secure them together. As the motorcycle owner turned the screw, the working cam of the mount would wedge together against the fins and tighten to hold the product securely in place on the motorcycle. The cooling air entering the tubing is directed past the front cylinder and towards the rear. The rear end of the tube is opened around the front left and right front portion of the rear cylinder. This enables the cooling incoming air to keep the cylinder temperature down so overheating is not experienced. The present invention apparatus allows hot air from the first cylinder to be completely redirected beyond the right side of the second cylinder to aid in the cooling operation. The faster the operator rode the motorcycle, the faster cool airflow is directed around the second cylinder. This helps keep the second cylinder cool to prevent overheating and possible damage. It also keeps the rider's seat cooler for more comfortable and enjoyable travel.

The present invention apparatus fulfills the need for directing cooling air to the cylinder of a motorcycle equipped with a V-twin engine. The appealing features of the present invention are its protection, operative comfort, and cost-effectiveness. Instead of allowing the rear engine cylinder to repeatedly overheat and slowly burn due to being starved of cooling air, fresh air is routed to the cylinder through this product. This keeps the rear cylinder cool and fully operational for the lift of the bike, thereby sparing the owner unnecessary stress, worry, and the possibly of expensive repairs. The present invention apparatus is also simple to install, attractively styled, durable and efficient.

Figure 1:
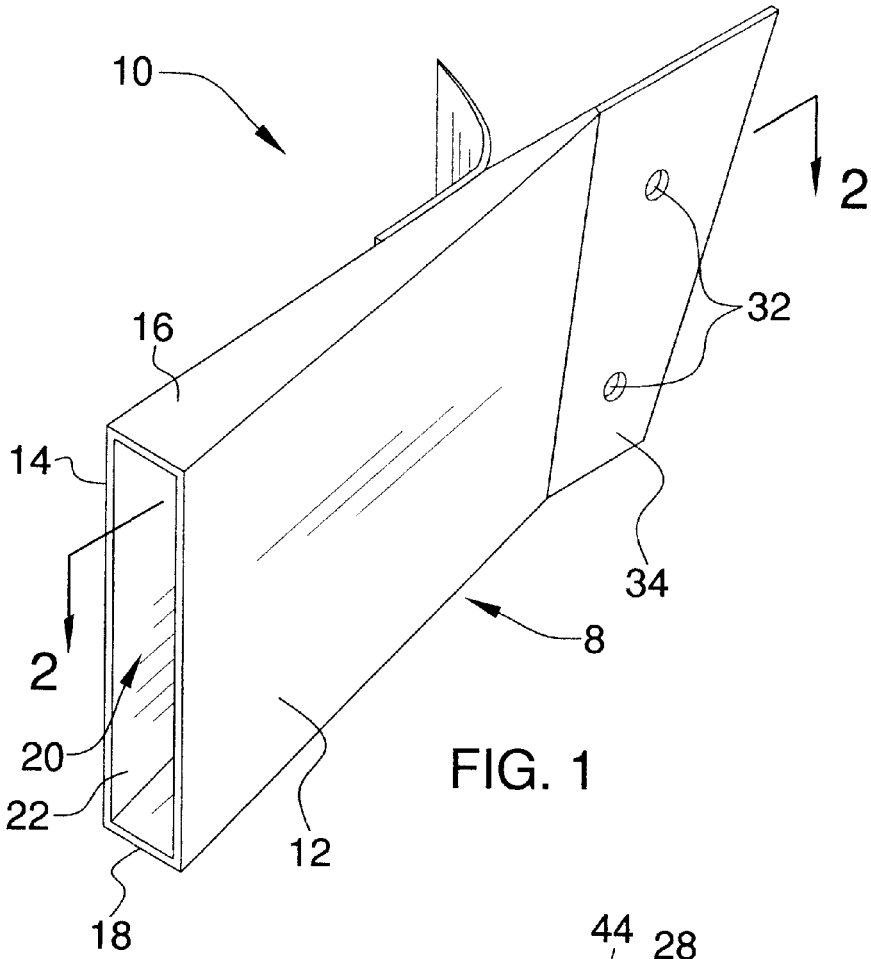
FIG. 1 is a perspective view of the present invention cooling air conduit for V-twin cylinders.

Referring initially to FIG. 1, wherein a perspective view of the present invention cooling air conduit 10 for a motorcycle engine cylinder is illustrated. The cooling air conduit 10 is formed generally of an elongated, tapered shape by a top panel 12, a bottom panel 14, and two side panels 16,18. The two side panels 16,18 has a width that is less than ⅓ of a width for the top or bottom panels, which are normally of the same width. A passageway 20 is formed inbetween the top panel 12, the bottom panel 14, and the two side panels 16,18 which has an inlet 22 and an outlet 24 to allow cool air to pass therethrough.

Figure 2:
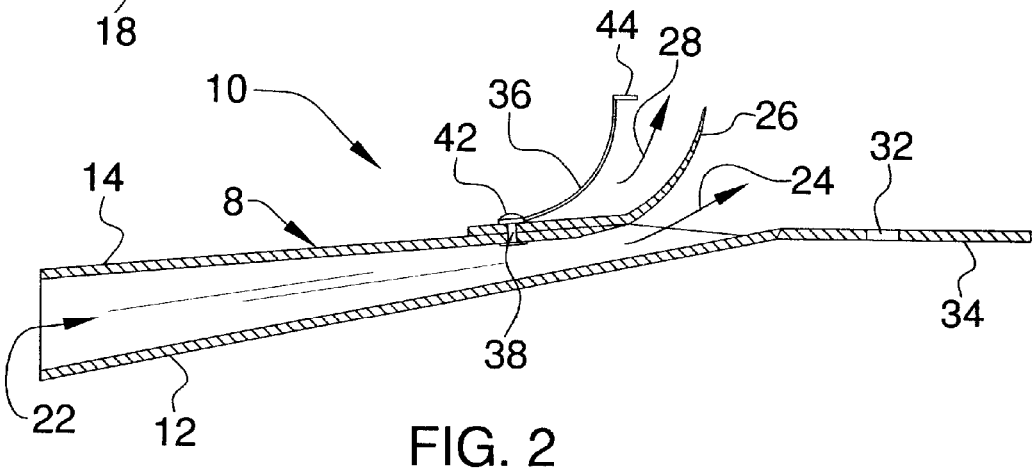
FIG. 2 is a cross-sectional view of the present invention cooling air conduit for V-twin cylinders.
Figure 3:
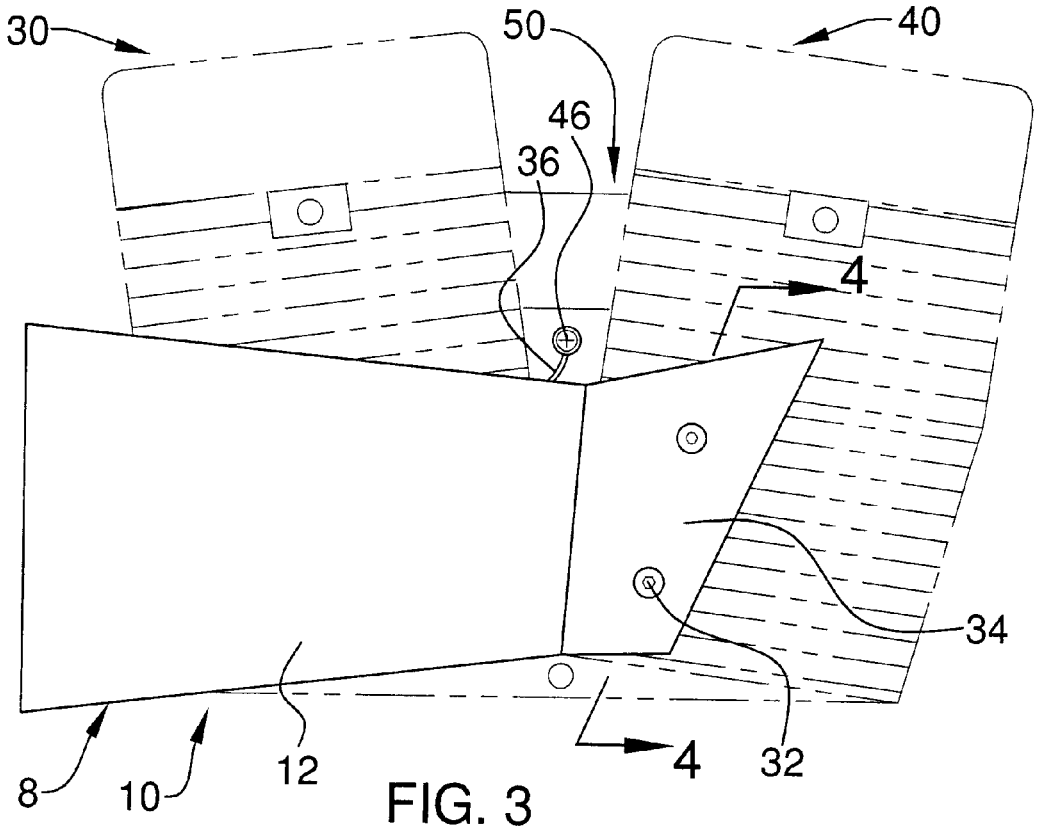
FIG. 3 is a front view of the present invention cooling air conduit as mounted on a V-twin engine.

A first length of the top panel 12 is larger than a second length of the bottom panel 14 wherein an end portion of the bottom panel 26 at the outlet 24 curves away from the top panel 12 to deflect a hot air flow 28, shown in FIG. 2, from an adjacent engine cylinder 30 shown in FIG. 3, away from an engine cylinder 40 to be cooled. This is also shown in FIG. 3.

At least one mounting hole 32, where two mounting holes 32 are shown in FIG. 3, is provided at an end portion 34 of the top panel 12 for mechanically attaching the cooling air conduit body 8 to the engine cylinder 40 that is designed to be cooled by the present invention apparatus 10. Also shown in FIGS. 2 and 3 is a safety cable 36 that is attached to the bottom panel 14 through a mounting hole 38 and a screw 42. The free end 44 of the safety cable 36 is attached to the engine block 50 by a screw 46. The safety cable 36 prevents the southern dislodge of the cooling air conduit 10 from the motorcycle engine should the mounting screws 32 suddenly fails and thus not holding the cooling air conduit 10 to the motorcycle engine.

Figure 4:
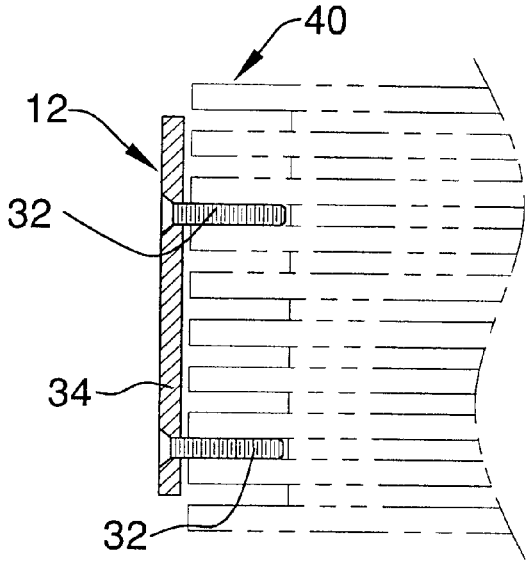
FIG. 4 is a partial, cross-sectional view illustrating how the present invention cooling air conduit is mounted on the rear cylinder of the V-twin engine.

An enlarged, cross-sectional view of the mounting method for the mounting screws 32 and the end portion 34 of the top panel 12 is also shown in FIG. 4, in a partial, cross-sectional view.

The present invention conduit body 8 can be advantageously fabricated in a sheet metal of any suitable metallic material, such as aluminum or stainless steel, etc. The mounting screws 32 used on the cylinder 40 should be of the anti-vibration type so that they will hold the conduit 10 securely to cylinder 40 even after the extended service conditions.

The present invention cooling air conduit for V-twin cylinders has therefore been amply described in the above descriptions and in the appended drawings of FIGS. 1-4.

While the preferred embodiments of the invention have been described above, it will be recognized and understood that various modifications can be made in the invention and the appended claims are intended to cover all such modifications which may fall within the spirit and scope of the invention.

What is claimed is:

1. A cooling air conduit for motorcycle engine cylinders comprising:

a conduit body of elongated, tapered shaped formed by a top panel, a bottom panel, and two side panels, said two side panels having a width less than ⅓ of a width of said top or bottom panels;

a passageway formed inbetween side top, bottom panels and said two side panels which having an inlet and an outlet for cool air to pass therethrough;

a first length of said top panel larger than a second length of said bottom panel wherein an end portion of said bottom panel at said outlet curves away from said top panel to deflect a hot air flow from an adjacent engine cylinder away from an engine cylinder to be cooled; and at least one mounting hole at an end portion of said top panel for mechanically attaching said conduit body to said engine cylinder to be cooled.

2. The cooling air conduit for motorcycle engine cylinders according to claim 1, wherein said conduit body is formed of a sheet metal material.

3. The cooling air conduit for motorcycle engine cylinders according to claim 1, wherein said conduit body is formed of stainless steel.

4. The cooling air conduit for motorcycle engine cylinders according to claim 1, wherein said conduit body is formed of aluminum.

5. The cooling air conduit for motorcycle engine cylinders according to claim 1, wherein said at least one mounting hole is two mounting holes.

6. The cooling air conduit for motorcycle engine cylinders according to claim 1 further comprising a safety cable connecting the cooling air conduit to an engine block of the motorcycle engine.

* * * * *